United States Patent [19]

Tanaka

[11] Patent Number: 4,520,495

[45] Date of Patent: May 28, 1985

[54] FAILURE DETECTION CIRCUIT FOR AN X-RAY TUBE

[75] Inventor: Shigeru Tanaka, Ootawara, Japan

[73] Assignee: Tokyo Shibaura Denki Kabushiki Kaisha, Kanagawa, Japan

[21] Appl. No.: 444,368

[22] Filed: Nov. 26, 1982

[30] Foreign Application Priority Data

Nov. 30, 1981 [JP] Japan ..... 56-192016

[51] Int. Cl.[3] ..... H05G 1/26; H05G 1/34; H05G 1/54

[52] U.S. Cl. ..... 378/117; 315/107; 361/87

[58] Field of Search ..... 315/107; 378/117, 118; 361/5, 87

[56] References Cited

U.S. PATENT DOCUMENTS

| | | | |
|---|---|---|---|
| 2,985,762 | 5/1961 | Euler | 315/106 |
| 3,732,463 | 1/1972 | Dale | 361/87 |
| 3,746,862 | 7/1973 | Lombardo | 378/118 |
| 3,906,258 | 9/1975 | Moe | 361/87 |
| 4,072,865 | 2/1978 | Craig | 378/110 |
| 4,090,106 | 5/1978 | Okumura | 315/107 |
| 4,291,356 | 9/1981 | Mathieu | 361/87 |

FOREIGN PATENT DOCUMENTS

| | | | |
|---|---|---|---|
| 0035433 | 9/1981 | European Pat. Off. . | |
| 2113346 | 7/1972 | France | 378/117 |
| 56-36900 | 4/1981 | Japan | 378/118 |
| 2049320 | 12/1980 | United Kingdom | 378/117 |

*Primary Examiner*—Alfred E. Smith
*Assistant Examiner*—Charles F. Wieland
*Attorney, Agent, or Firm*—Cushman, Darby & Cushman

[57] ABSTRACT

A failure detection circuit for a center metal grounded type X-ray tube. If the high voltage applying line for the anode side is kept opened and simultaneously for the cathode side is closed, the extraordinary cathode current may flow from the cathode through the center metal to the earth, which may cause a failure of the X-ray tube. In order to avoid such problem, there are provided the anode/cathode failure detectors which may interlock the operation of the X-ray radiation control circuit so as not to apply high voltages to the anode/cathode of the X-ray tube when failed in the high voltage apply lines.

10 Claims, 5 Drawing Figures

X-RAY RADIATION CONTROL CIRCUIT
PULSE GENERATING CIRCUIT
PULSE GENERATING CIRCUIT
INTERLOCK CIRCUIT
RESET
RESET
LED1
LED2
+V
+V
+V1
-V1
SW1
SW2
E1
E2
E3
S1
S2
S3
S3'
S3"
S4
S4'
S5
S6
S7
S8
S9
S10
S11
10
12
14
16
18
20
30P
30K
32
34
40P
40K
41
42
43
44
45
46
47
48
50
60
70
80
90
110
120
130
140

FAILURE DETECTION CIRCUIT FOR AN X-RAY TUBE

BACKGROUND OF THE INVENTION

This invention relates generally to a failure detection circuit for an X-ray tube power source, and relates more specifically to a failure detection circuit used in a high tension power source for a center metal grounded type X-ray tube.

In a typical known power source used for the X-ray tube of which the center metal is grounded, there is provided a switching element such as a tetrode between either the anode or the cathode of the X-ray tube and the high tension power source, which is used to control the X-ray radition projected from the X-ray tube.

In such high tension power sources, if a high voltage is not applied to the anode of the X-ray tube but to the cathode thereof, and furthermore the filament is heated, an extraordinary current flows between the cathode and the center metal. It is, therefore, dangerous that the X-ray tube may fail.

Several causes may be considered for the failure of the X-ray tube: high-voltage cable disconnections of the anode side, loose contact of the bushing at the anode side, problems (open circuit) in the switching element at the anode side, problems (closed circuit) in the switching element at the cathode side, and so on. For those reasons, when the open circuit is made in the anode side, the normal high voltage is applied to the cathode side and the filament is energized, this high voltage is subjected to be applied between the cathode and the center metal, so that the extraordinary current flows through them which may cause the fusing of the center metal, and the failure of the X-ray tube.

It is therefore an object of the present invention to provide a failure detection circuit of the X-ray tube power source so as to prevent the failure of the X-ray tube by detecting the failure of high tension supply to the X-ray tube.

SUMMARY OF THE INVENTION

The failure detection arrangement for an X-ray tube, according to the invention comprises: a center metal grounded type X-ray tube of which center metal is grounded; high tension power sources for applying high voltages to the anode and the cathode of said X-ray tube respectively; an X-ray radiation control circuit means for controlling switching means connected between said anode and said one high tension power source, and between said cathode and said other high tension power source so as to cut off high voltages applied to the anode and the cathode of the X-ray tube respectively; a failure detector means coupled to said high tension power sources and producing a failure detection signal in case that only the cathode current is detected and substantially simultaneously the anode current is not detected; and an interlock circuit means producing an interlock signal upon receipt of said failure detection signal and supply it to said X-ray radiation control circuit means so as to interrupt X-ray radiation from the X-ray tube.

According to the present invention the advantage is provided that a simple failure detection circuit for an X-ray tube can be realized so as to prevent failure of an X-ray tube by detecting the extraordinary current in the high voltage supply to the X-ray tube.

BRIEF DESCRIPTION OF THE DRAWINGS

The invention will be best understood from the following description considered in connection with the accompanying drawings.

DETAILED DESCRIPTION OF THE PREFERRED EMBODIMENTS

The principle operation of the present invention is as follows. When only the cathode current of the X-ray tube is detected and substantially simultaneously no anode current thereof is detected, applying high tension DC voltage to the X-ray tube is immediately stopped.

Figure 1:
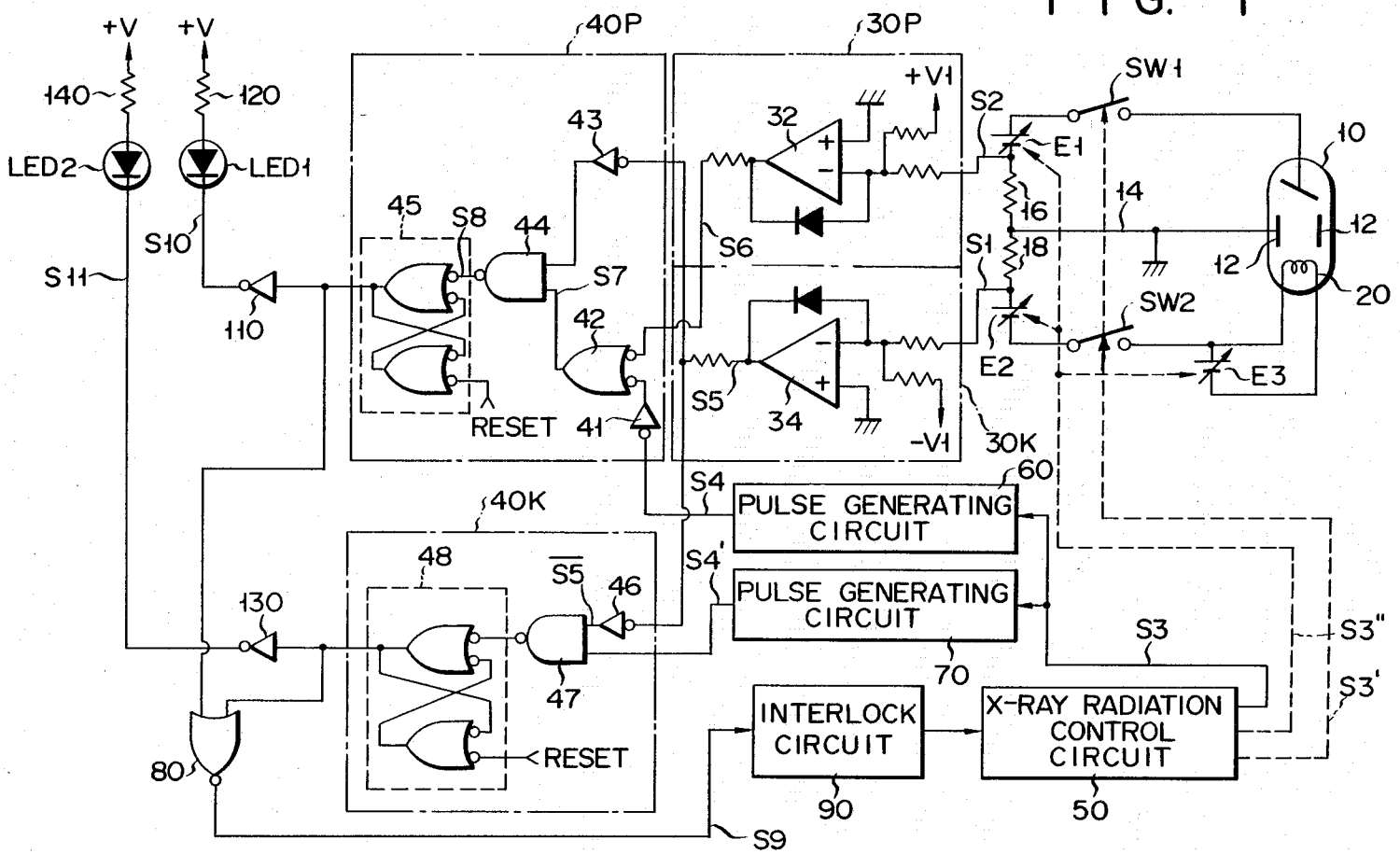
FIG. 1 shows a circuit diagram of one preferred embodiment of the failure detection circuit for the center metal grounded type X-ray tube according to the invention.

FIG. 1 is a circuit diagram showing one preferred embodiment according to the present invention. Referring to FIG. 1, the numeral 10 denotes an X-ray tube, of which center metal 12 is connected to a ground line 14. The anode of the X-ray tube 10 is connected to a positive high tension power source E1 through a switching element (e.g. a tetrode) SW1, while the cathode thereof is similarly connected to a negative high tension power source E2 through a switching element (e.g. a tetrode) SW2. A resistor 16 is connected between the ground line 14 and the positive high tension power source E1, and a resistor 18 is between the ground line 14 and the negative high tension power source E2. These resistors 16 and 18 are to be used for detecting the anode current and the cathode current respectively. A filament heating power source E3 is connected to a filament 20 of the X-ray tube 10.

The X-ray tube 10 is of the direct heating cathode type, of which filament functions in common with the cathode. The cathode (filament) 20 is biased negatively with respect to the anode as well as the earthed center metal. It should be noted that in this embodiment, high voltage is treated in the X-ray tube power supply circuit just described, but lower voltage is treated in the below-mentioned remaining circuits.

The numerals 30P and 30K indicate detection circuits for the anode and the cathode currents of the X-ray tube 10 respectively, which circuits are connected to the resistors 16 and 18 respectively.

The first current detection circuit 30P comprises a first comparator 32 which adds an anode current signal S2 flowing through the resistor 16 and a current flowing from a DC positive power source +V1 at the comparison terminal thereof and which produces a detection signal S6 for anode current. The second current detection circuit 30K comprises a second comparator 34 which adds an anode current signal S1 flowing through the resistor 18 and a current flowing from a DC negative power source −V1 at the comparison terminal thereof and which produces a detection signal S5 for cathode current. A reference numeral 50 denotes an X-ray radiation control circuit which produces an X-ray projection start signal S3 and a tetrode switching signal S3′ in synchronism therewith. The X-ray radiation control circuit 50 also produces a signal S3″ used for controlling the positive and negative high tension power sources E1 and E2 as well as the filament heating power source E3. Reference numerals 60 and 70 denote first and second pulse generating circuits, respectively. The first pulse generating circuit 60 produces a pulse S4 in response to the X-ray projection start signal S3. This pulse S4 has a pulse width slightly shorter than that of the X-ray projection start signal S3. The second pulse generating circuit 70 produces a pulse S4′ in response to the X-ray projection start signal S3. The pulse S4′ has a pulse width slightly wider than that of the X-ray projection signal S3.

Numerals 40P and 40K denote anode and cathode failure detectors, respectively. The anode failure detector 40P comprises a first NOR gate 42, the inversion terminal of which receives the detection signal S6 for anode current and an output from a first inverter 41 inverting the pulse signal S4 from the first pulse generating circuit 60; a first NAND gate 44 which receives an output from a second inverter 43 inverting the detection signal S5 for cathode current and an output signal S7 from the first NOR gate 42; and a first flip-flop 45 which is set by an output signal S8 derived from the first NAND gate 44 and is reset by a reset signal from an external signal source (not shown) or by an initial reset signal RESET produced upon energization of the circuit. A set signal S9 from the flip-flop 45 is supplied to an interlock circuit 90 through a second NOR gate 80. The interlock circuit 90 then produces an interlock signal to interrupt the operation of the X-ray radiation control circuit 50. An output signal S10 from a third inverter 110 which inverts the output signal from the anode failure detector 40P is supplied to an anode failure indicator LED1 and a resistor 120 which is connected to a DC power source +V.

The cathode failure detector 40K comprises a fourth inverter 46 which inverts the detection signal S5 for cathode current; a second NAND gate 47 which receives an output from the fourth inverter 46 and the pulse signal S4′ from the second pulse generator 70; and a second flip-flop 48 which is set in response to an output signal from the second NAND gate 47 and is reset in response to a reset signal RESET. An output signal from the second flip-flop 48 is inverted by a fifth inverter 130 which then supplies an output signal S11 to a cathode failure indicator LED2 and a resistor 140 which is connected to the DC power source +V. The output signal from the cathode failure detector 40K is also supplied to the interlock circuit 90 through the second NOR gate 80.

Now the operation of this embodiment will be explained with reference to the timing charts of FIGS. 2 and 3.

When a high voltage is applied across the X-ray tube 10 in normal operation, the X-ray projection start signal S3 is produced by the X-ray radiation control circuit 50. A switch driver circuit (not shown) is then turned ON and the tetrode switches SW1 and SW2 are turned ON to apply a predetermined high voltage between the cathode and the anode of the X-ray tube 10. As a result, X-ray projection is properly performed.

As well known in the art, since an X-ray projection is effected interruptedly, the waveform of, for example the cathode current S1 is pulsatory.

In this embodiment, it has been decided in such that the detection signal for cathode current S5 from the cathode current detection circuit 30K has "0" level in case of detection (= no failure in the cathode supply circuit), and "1" level in case of no detection (= the failure in the cathode supply circuit), to the contrary, the detection signal for anode current S6 from the anode current detection circuit 30P has "1" level in case of detection (= no failure in the anode supply circuit), and "0" level in case of no detection (= failure in the anode supply circuit).

Then in the above-mentioned case (= no failure), the output signal S5 has "0" level derived from the cathode current detection circuit 30K, and the output signal S6 has "1" level derived from the anode current detection circuit 30P, so that the output signal S8 from NAND gate 44 of the anode failure detector 40P has "1" level, because the output signal of the inverter 43 has "1" level and that of NOR gate 42 (S7) has "0" level. As a result, the first flip-flop 45 of the anode failure detector 40P is not brought into "set" condition, so that since both the interlock input signal S9 and the LED driving signal S10 remain "1" level, the interlock circuit 90 does not interlock the X-ray radiation control circuit 50 and the anode failure indicator LED1 is not in operative.

On the other hand, in response to the output signal from the fifth inverter 46 and the pulse signal S4′ from the second pulse generator 70, the output signal of the second NAND gate 47 has "1" level, so that the second flip-flop 48 is not set and its output has "0" level. Accordingly, neither the cathode failure indicator LED2 nor the interlock circuit 90 is brought into operation. These waveforms are shown in FIG. 2 (a time period from times t0 to t1).

Now assume that the tetrode switch SW1 remains opened due to one of the aforesaid reasons even through the tetrode switch SW2 is properly operated. In this case, the detection signal for anode current S6 does not change from "0" level at time t1, as shown in FIG. 2 (the extraordinary current flows from the cathode through the center metal to the earth). The output signal S8 from the first NAND gate 44 in the anode failure detector 40P corresponds to an inverted signal of the output signal S7 from the first NOR gate 42. For this reason, the first flip-flop 45 is set to produce an output signal of "1" level. The output signal S10 from the inverter 110 goes to "0" level. As a result, the anode failure indicator LED1 goes on to signal the failure of the X-ray tube 10. At the same time, the failure signal S9 is supplied to the interlock circuit 90 through the NOR gate 80. The interlock circuit 90 then produces the interlock signal to interrupt the operation of the X-ray radiation control circuit 50. Accordingly the positive and negative high tension power sources E1 and E2, and the filament heating power source E3 are turned OFF. Thus, interlocking is performed.

Figure 2:
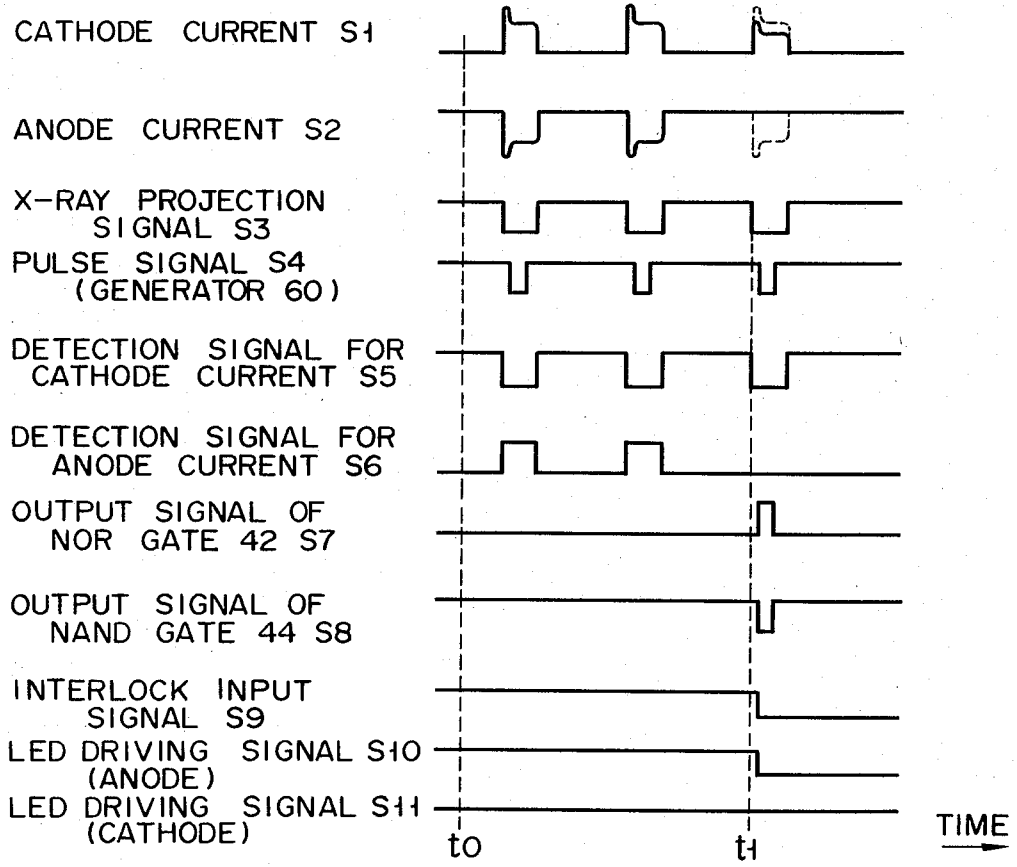
FIG. 2 shows a waveform chart in case of the anode open failure occured in the circuit shown in FIG. 1.
Figure 3:
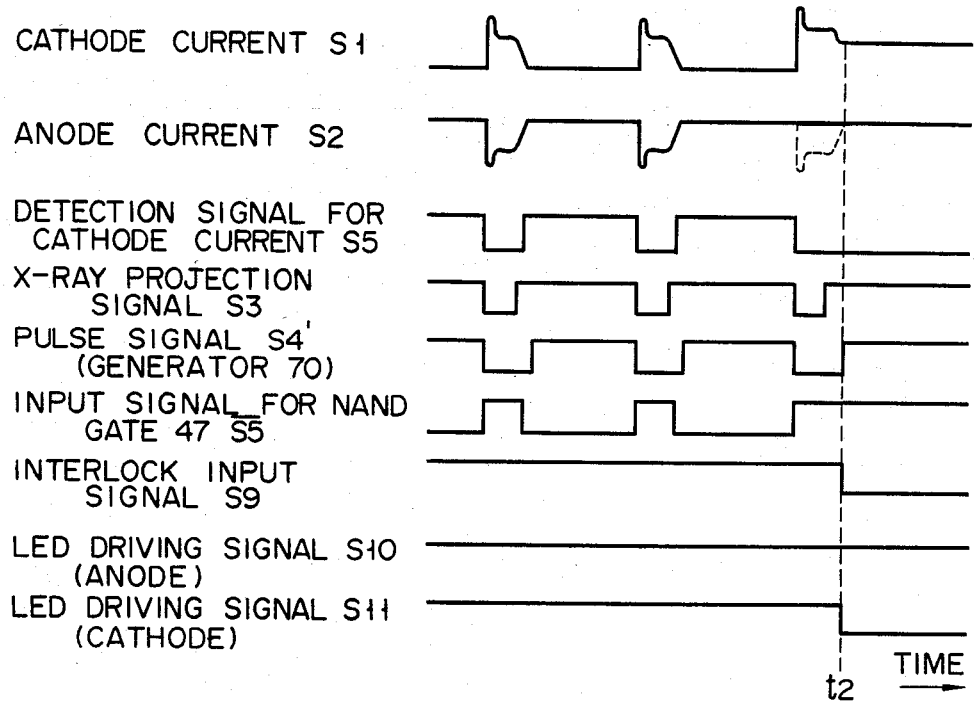
FIG. 3 shows a waveform chart in case of the cathode close failure occured in the circuit shown in FIG. 1.

In this failure case (anode open case), as seen from FIG. 2 the amplitude of the cathode current S1 varies compared with that of the normal cathode current, because it is influenced by the cathode-to-center metal extraordinary current. The waveforms of this anode open failure are shown in FIG. 2 (a time period from times t1 to end).

Assume that the tetrode switch SW2 is kept connected due to one of the aforesaid reasons. In this case, when the tetrode switch SW1 is turned ON, a normal current flows through the X-ray tube 10. However, when the tetrode switch SW1 is turned OFF, a current continues to flow through the cathode-to-center metal path. As a result, even if the X-ray projection start signal S3 is set to OFF ("1" level), the extraordinary current flows between the cathode and the center metal. In the cathode failure detector 40K, as indicated at time t2 shown in FIG. 3, when an inverted signal $\overline{S5}$ of the detection signal S5 for cathode current is set to "1" level and when the output signal S4' from the second pulse generator 70 is set to "1" level, the second flip-flop 48 is set to "1" level. The output signal S11 from the fifth inverter 130 becomes "0" level, so that the cathode failure indicator LED2 goes on. Meanwhile interlocking is performed through the NOR gate 80 as same as in the above failure case.

Another failure may be detected by the cathode failure detector 40K in such a case that the tetrode switches SW1 and SW2 remain closed. In the same manner as described above, even if the X-ray projection start signal S3 is OFF ("1" level), the extraordinary current continues to flow through the X-ray tube 10. The cathode failure indicator LED2 goes on, and then interlocking is performed.

As may be apparent from the above description, the two failure detectors allows the detection of the failure of the X-ray tube 10 to which a high voltage is applied. Interlocking is then performed to effectively prevent the failure of the X-ray tube.

The present invention is not limited to the above embodiments. Various changes and modifications may be made within the technical spirit and scope of the present invention.

For example, as an alternative embodiment the first and second pulse generators 60 and 70 may be omitted from the circuit shown in FIG. 1. The presence or absence of the anode and cathode currents may be merely detected. If no current is detected, the interlock signal S9 may be produced.

Furthermore it is possible to modify the function of the anode failure detector 40P in such that it is provided a threshold level detector (not shown) for detecting whether the level of the anode current signal S2 becomes lower than the predetermined value without utilizing the cathode current signal S1, and the detector 40P may set the flip-flop 45 to the failure level.

Figure 4:
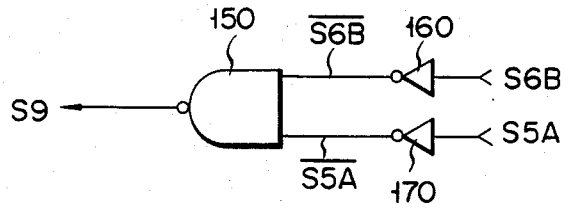
FIG. 4 shows a circuit diagram for combining two failure detectors of FIG. 1 into one failure detector.
Figure 5:
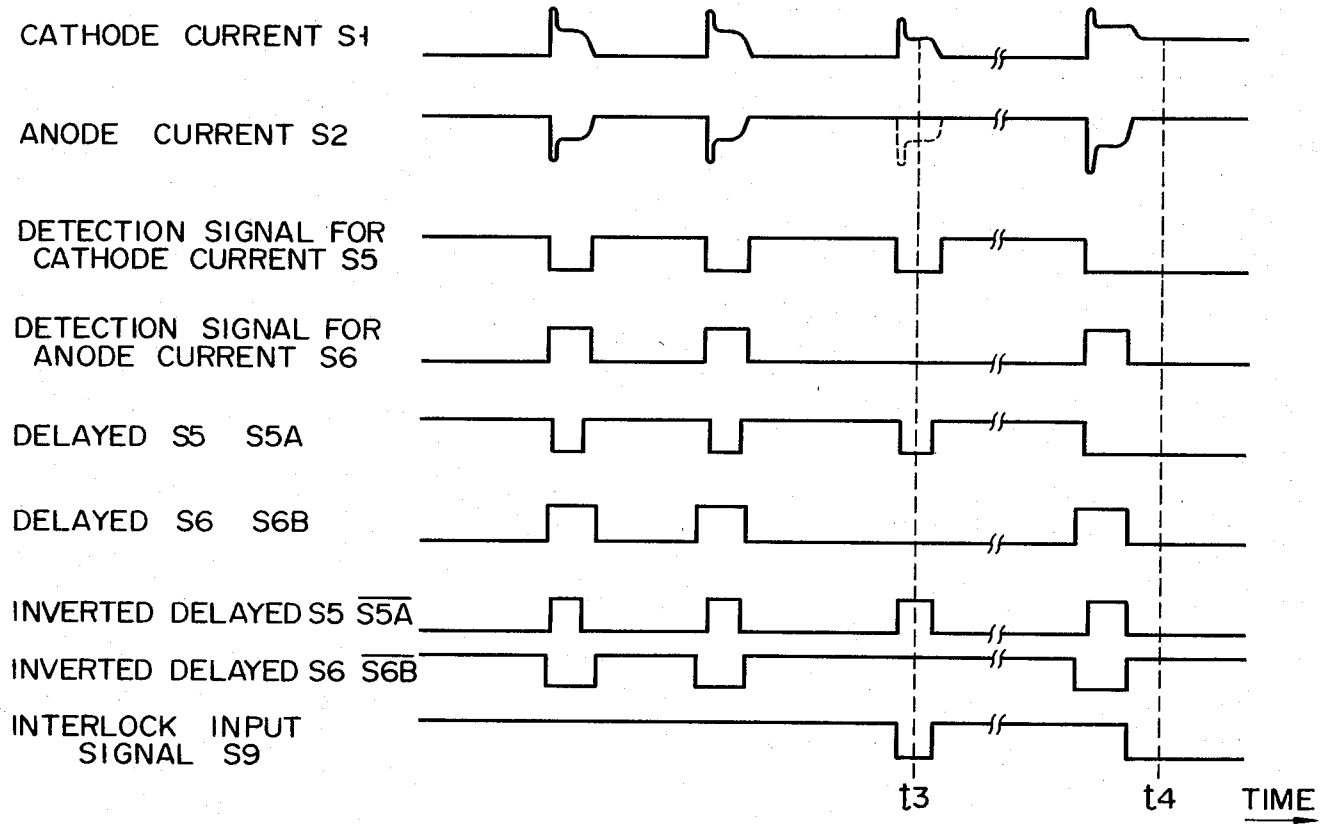
FIG. 5 shows a waveform chart in case that one failure detector of FIG. 4 is employed into the circuit of FIG. 1.

Then, the anode/cathode failure detectors 40P/40K may be combined in a single logic circuit, as shown in FIG. 4. As shown in the timing charts in FIG. 5, a first delayed signal S5A has a delayed leading edge as compared with the leading edge of the detection signal for cathode current S5. A second delayed signal S6B has a delayed trailing edge as compared with the trailing edge of the detection signal for anode current S6. The first delayed signal S5A is inverted by an inverter 170. Similarly, the second delayed signal S6A is inverted by an inverter 160. Both inverted signals $\overline{S5A}$ and $\overline{S6B}$ are supplied to a third NAND gate 150. This third NAND gate 150 produces the failure signal S9. Namely, the circuit is not limited to particular configuration. Any available circuit may be used, provided that an interlock signal is produced whenever the detection signal for cathode current S5 is detected and substantially simultaneously no anode current signal is detected. When no anode current S2 is detected (= anode failure), the interlock signal S9 becomes "0" level as shown in FIG. 5 at time t3. Also when the cathode current S1 continues to flow (= cathode failure), the interlock signal S9 becomes "0" level as shown in FIG. 5 at time t4.

As described above, when only the tetrode switch SW2 is closed, the extraordinary current flowing from the center metal to the ground becomes 7 to 10 times the normal current. Therefore, the above extraordinary current may be detected to achieve the object of the present invention.

To this end, a resistor having a proper resistance value may be connected between the ground line 14 and ground so as to apply a voltage drop across it to the second comparator 34. It should be noted that there are other possibilities to select to the other levels different from that of the outputs of the detection signals S5 and S6.

In the above embodiment, a case has been described in which pulse mode X-ray generators using switching elements such as tetrode switches are used. However, the present invention is not limited to the above arrangement, but may be extended to various types of X-ray generators.

What is claimed is:

1. A failure detection arrangement for an X-ray tube of the type having an anode, a cathode and a grounded center metal, comprising:

a first high voltage source for applying a positive high voltage between said anode and ground;

a first switch in the circuit of said first high voltage source and said anode;

a second high voltage source for applying a negative high voltage between said cathode and ground;

a second switch in the circuit of said second high voltage source and said cathode;

control circuit means for generating X-ray control signals for controlling said first and second switches for selectively closing and opening circuit paths of said anode and cathode;

failure detection means for detecting when a cathode current is flowing and substantially simultaneously therewith an absence of any anode current and generating in response to such detection a failure detection signal; and means, responsive to said failure detection signal, for causing said control circuit means to interrupt power flow to said tube by controlling of said first and/or second switches.

2. An arrangement according to claim 1 wherein said failure detection means comprises:

means for detecting the presence of anode current and generating an anode current detection signal indicative thereof;

means for detecting the presence of cathode current, and generating a cathode current detection signal indicative thereof;

means for generating pulse signals related to said X-ray control signals; and means for comparing said anode and cathode current detection signals with said pulse signals to generate said failure detection signal.

3. An arrangement according to claim 1 further comprising means for indicating the status of anode current.

4. An arrangement according to claim 1 further comprising means for indicating the status of both anode and cathode currents.

5. A failure detection arrangement for an X-ray tube of the type having an anode, a cathode and a grounded center metal, comprising:

a first high voltage source for applying a positive high voltage between said anode and ground;

a first switch in the circuit of said first high voltage source and said anode;

a second high voltage source for applying a negative high voltage between said cathode and ground;

a second switch in the circuit of said second high voltage source and said cathode;

control circuit means for generating X-ray control signals for controlling said first and second switches for selectively closing and opening circuit paths of said anode and cathode;

failure detection means for detecting when an anode current falls below a predetermined level and generating, in response to such detection, a failure detection signal; and means, responsive to said failure detection signal, for causing said control circuit means to interrupt power flow to said tube by appropriate control of said first and/or second switches.

6. An arrangement according to claim 5 further comprising means for indicating the status of anode current.

7. An arrangement according to claim 5 further comprising means for indicating the status of both anode and cathode currents.

8. A failure detection arrangement for an X-ray tube of the type having an anode, a cathode and a grounded center metal, comprising:

a first high voltage source for applying a positive high voltage between said anode and ground;

a first switch in the circuit of said first high voltage source and said anode;

a second high voltage source for applying a negative high voltage between said cathode and ground;

a second switch in the circuit of said second high voltage source and said cathode;

control circuit means for generating an X-ray control signal for controlling said first and second switches for selectively closing and opening circuit paths of said anode and cathode;

an anode current detection circuit for detecting anode current and providing an anode current detection signal indicative of a status of the anode current;

a cathode current detection circuit for detecting cathode current and providing a cathode current detection signal indicative of a status of the cathode current;

a first pulse generating circuit for generating a first pulse signal related to said X-ray control signal;

a second pulse generating circuit for generating a second pulse signal related to said X-ray control signal;

an anode failure detector for generating an anode failure signal that is a logic product of said first pulse signal, and anode and cathode detection signals;

a cathode failure detector for generating a cathode failure signal that is a logic product of said second pulse signal and said cathode detection signal;

means for logically combining said anode and cathode failure signals; and interlock circuit means, coupled to said logic combining means, for controlling said control circuit.

9. An arrangement according to claim 8 further comprising means for indicating a status of anode current.

10. An arrangement according to claim 8 further comprising means for indicating a status of both anode and cathode current.

* * * * *